US005085932A

United States Patent [19]

Fujita et al.

[11] Patent Number: 5,085,932

[45] Date of Patent: Feb. 4, 1992

[54] TRANSPARENT PLASTIC PRINTING FILM

[75] Inventors: Noboru Fujita; Toru Orisaka; Akira Haneda; Yuukichi Miyokawa; Jun Arikawa, all of Sayama, Japan

[73] Assignee: Dynic Corporation, Kyoto, Japan

[21] Appl. No.: 523,251

[22] Filed: May 14, 1990

Related U.S. Application Data

[63] Continuation of Ser. No. 259,491, Oct. 17, 1988, abandoned, which is a continuation-in-part of Ser. No. 145,500, Dec. 8, 1987, abandoned, which is a continuation-in-part of PCT/JP87/00191, Mar. 27, 1987.

[30] Foreign Application Priority Data

| | | | |
|---|---|---|---|
| Apr. 9, 1986 | [JP] | Japan | 61-80158 |
| Apr. 18, 1986 | [JP] | Japan | 61-90819 |
| Apr. 21, 1986 | [JP] | Japan | 61-91668 |
| May 13, 1986 | [JP] | Japan | 61-110417 |
| Jul. 19, 1986 | [JP] | Japan | 61-170645 |
| Jan. 20, 1987 | [JP] | Japan | 62-8950 |

[51] Int. Cl.[5] ..... B41M 5/00

[52] U.S. Cl. ..... 428/331; 346/135.1; 427/256; 428/195; 428/409; 428/521; 428/522; 428/914

[58] Field of Search ..... 346/135.1, 1.1; 428/195, 207, 211, 500, 521, 331, 409, 522, 914; 427/256

[56] References Cited

U.S. PATENT DOCUMENTS

| | | | |
|---|---|---|---|
| 4,446,174 | 5/1984 | Maekawa et al. | 428/211 |
| 4,614,681 | 9/1986 | Hayashi et al. | 428/207 |
| 4,664,952 | 5/1987 | Arai et al. | 428/195 |
| 4,701,837 | 10/1987 | Sakaki et al. | 428/195 |
| 4,732,786 | 3/1988 | Patterson et al. | 428/211 |
| 4,741,969 | 5/1988 | Hayama et al. | 428/514 |

*Primary Examiner*—Pamela R. Schwartz

*Attorney, Agent, or Firm*—Frishauf, Holtz, Goodman & Woodward

[57] ABSTRACT

This invention relates to a transparent plastic printing film suitable for offset printing or letterpress printing where an oil ink of the oxidative polymerization type is used. An ink-setting layer composed principally of a rubbery resin and/or styrene resin is provided on at least one side of a transparent plastic film, whereby the transparent plastic printing film permits lithographic offset or the like without losing the transparency of the film. Fine ruggedness may be formed on at least one side of the transparent plastic printing film. The transparent plastic printing film may also be subjected to an antistatic treatment. Sheet-fed printing making use of the above film does not develop blocking, tacking, scratch abrasion, etc. The above-described various properties have been improved further in a transparent plastic printing film provided with an ink-setting layer, which has been formed by coating a mixture of (i) a solution of the rubbery resin and/or styrene resin and (ii) a silica sol.

14 Claims, No Drawings

TRANSPARENT PLASTIC PRINTING FILM

This application is a continuation of application Ser. No. 07/259,491, filed Oct. 17, 1988, (abandoned) which is a continuation-in-part of Ser. No. 07/145,500 filed Dec. 8, 1987, (abandoned) which is a continuation-in-part of application Ser. No. PCT/JP87/00191 filed Mar. 27, 1987.

This invention relates to transparent plastic printing films, specifically, to transparent plastic printing films suitable for lithographic offset or letterpress printing in which oil inks of the oxidative polymerization type are used, and also to a composition used as an ink-setting layer of a printing medium.

Printing or patterning of plastic films has conventionally been conducted by gravure printing, flexogravure printing, screen printing or the like, which permits selection of a printing ink having good compatibility with the plastic films from a wide range of printing inks. These printing processes are however accompanied by one or more drawbacks such that the production of printing plates is costly, the workability is insufficient, the tone reproduction of printed marks is poor, and marks tend to lack vividness.

In contrast to the above-described printing processes, lithographic offset enjoys a low cost for the production of printing plates, easy practice, good tone reproduction of marks, and high vividness. It has hence been desired to print plastic films by lithographic offset. Solvent inks or water inks are used in many instances for the printing or patterning of impervious materials such as plastics, since the printing media do not permit penetration of printing inks. Ultraviolet curable inks or electron beam curable inks may also be used, although not very often Oil inks are generally employed in lithographic offset and letterpress printing. In order to modify the imperviousness of materials, it is hence necessary to provide ink-setting layers on the surfaces of the materials so that layers facilitating the penetration and setting of such inks are formed. The term "oil ink" as used herein means an ink the vehicle components of which include one or more oil components. An oil ink useful in lithographic offset or letterpress printing contains a colorant, resin, drying oil and high boiling-point petroleum solvent as principal components and additives such as wax compound and dryer are added further. It undergoes oxidative polymerization by oxygen in the air.

When a solvent ink or water ink is employed, problems arise that the environment of the printing workshop is aggravated and a long period of time is required for drying the ink.

When an ultraviolet curable ink or electron beam curable ink is used, the drying time of the ink is short but an expensive apparatus such as ultraviolet ray radiation apparatus or electron beam radiation apparatus is indispensable. Many of ultraviolet curable inks involve problems in both safety and health aspects, because they have specific offensive odor due to the influence of a reaction initiator and remaining monomers even after their drying.

Use of an oil ink can significantly minimize problems such as those mentioned above.

After printing with an oil ink of an oxidative polymerization type which is typically utilized in lithographic offset and letter-press printing, the oil ink will be immersed into a micro-void layer formed on the surface of the printing medium so that the oil ink is dehydrated to become in a so-called ink-set condition or an apparent dry state in which the ink could not be scrubbed down from the printing medium by fingers with a light tough. The oil ink is then reacted with oxygen in the air for oxidative polymerization, thereby forming an absolutely dry film on the printing medium. Such a micro-void layer, that is an ink-setting layer, has been prepared by incorporating a large quantity of filler or containing therein air voids. However, the filler or air voids will bring luminous diffusion or absorption to degrade transparency of the ink-setting layer. Consequently, those obtained by conducting lithographic offset or letter-press printing on transparent plastic sheets with the oil ink must have been opaque.

When it was necessary to print transparent plastic films like food bags and the like while retaining their transparency, a printing process making use of the above-mentioned solvent ink or water ink was employed.

In lithographic offset or letter-press printing on the other hand, films in the form of sheets are printed. This printing is accompanied by such problems that while the drying and curing of the ink through its oxidative polymerization has not been completed, films are superposed one over another and are hence smeared due to set off and bleeding of the ink. In an extreme instance, the blocking phenomenon takes place.

The following process has been employed in order to avoid the above-mentioned problems. Namely, plastic films are subjected to lithographic offset with an ultraviolet curable ink or electron beam curable ink. Immediately after their printing, they are exposed to ultraviolet or electron beams to cure the ink. This process however requires an expensive apparatus such as ultraviolet ray radiation apparatus or electron beam radiation apparatus. In the case of simultaneous multicolor printing in particular, one ultraviolet ray radiation apparatus must be provided for the printing of each color. The use of such many ultraviolet ray radiation apparatus however reduces the merit of lithographic offset that it can be practiced economically. Further, many of ultraviolet curable inks involve problems in both safety and health aspects, because they have specific offensive odor due to the influence of a reaction initiator and remaining monomers even after their drying.

When plastic films in the form of sheets are subjected to lithographic offset it is necessary as general properties in addition to taking the above-mentioned ink absorption and dry durability into consideration that stacked films are fed one after one smoothly to a printing machine, fed with good accuracy of register, ejected and then stacked in complete registration (pile-up). Namely, the films must have good running property For this purpose, it is necessary to prevent the triboelectrification and tacking of the stacked films and to lower their surface friction coefficient as well as to avoid blocking due to exposure to heat and moisture during the storage of the films. An underpaper has conventionally been brought into a contiguous relation with the back side of each film. To prevent the film and its associated underpaper from slipping off from each other in the course of their running, they are temporarily put together at some locations with an adhesive, self-adhesive, double-tack tape, or the like. Their temporary holding and subsequent separation work is irksome and moreover, requires the underpaper additionally.

Japanese Patent Laid-Open No. 96590/1979 discloses to the effect that a polyester film obtained by coating its surface with an acrylic copolymer, which is soluble in water or a lower aliphatic alcohol and has quaternary ammonium groups as salt-forming groups on side chains, is suitable for lithographic offset.

According to a reproduction of the above invention by the present inventors, the polyester film coated with the above-described copolymer was however found to have a slow ink drying and setting velocity. In addition, acrylic copolymers containing quaternary ammonium salts such as that disclosed in the above patent publication are poor in moisture and heat resistance. The present inventors conducted an experiment, in which sheets of polyester films coated with the above-described copolymer were stored in a stacked form. As a result, it was found that they absorbed moisture and induced blocking problems, namely, they tended to perform poor running even in a room of normal temperature. They are not satisfactory in general properties required for printing films, such as damage resistance, abrasion resistance and the like.

An object of this invention is therefore to provide a transparent plastic sheet which can be printed, without losing its transparency, with an oil ink of the oxidative polymerization type by lithographic offset or letterpress printing. Another object of this invention is to provide a transparent plastic film which can perform smooth running in sheet-fed printing and neither induces blocking nor undergoes tacking, damages, abrasion, etc.

Another object of this invention is to provide a composition suitable for use as an ink-setting layer of a printing medium, without degrading inherent transparency of the printing medium.

Another object of this invention is to provide a composition suitable for use as an ink-setting layer of a printing medium, without degrading inherent transparency of the printing medium.

In the first aspect of this invention, there is thus provided a transparent plastic printing film suitable for printing with an oil ink of the oxidative polymerization type, which comprises a transparent plastic film and an ink-setting layer consisting principally of a rubbery rubber like resin and/or styrene resin and provided on at least one side of the transparent plastic film. The transparent plastic printing film still retains transparency, features fast ink-setting, and provides a print having excellent print strength and scratch resistance. The rubbery resin may preferably be a resin which contains at least one polymer selected from styrene-butadiene copolymers, acrylonitrile-butadiene copolymers, methacrylic ester-butadiene copolymers, acrylonitrile-styrene-butadiene copolymers, methacrylic ester-styrene-butadiene copolymers and substituted derivatives thereof. The styrene resin may preferably be a resin which contains at least one polymer selected from styrenated alkyd resins, styrene-acrylic ester copolymers, styrene-methacrylic ester copolymers and substituted derivatives thereof.

In a preferred embodiment, fine ruggedness may be formed on at least one side of the transparent film, for example, by incorporating particles such as silica powder or embossing said at least one side. This allows air to remain within the spacing of the rugged surface so that the oxidative polymerization of the oil ink is promoted and the sheet running property, heat resistance and moisture resistance are improved to avoid the occurrence of blocking.

In another preferred embodiment, an antistatic treatment may be applied by mixing a conductive resin or antistatic agent or depositing a metal oxide on the surface of the film, whereby the transparent printing film is prevented from undergoing tacking due to static electricity.

In the second aspect of this invention, there is also provided a transparent plastic printing film suitable for printing with an oil ink of the oxidative polymerization type, comprising a transparent plastic film and an ink-setting layer provided on at least one side of the transparent plastic film by coating said at least one side of the transparent plastic film with a mixture of (i) a solution formed principally of a rubbery rubber like resin and/or styrene resin and (ii) a silica sol. The scratch resistance, heat blocking resistance and moisture blocking resistance of the transparent plastic printing film according to the second aspect of this invention have been improved further. Owing to the addition of the silica sol, the surface electrical resistance of the plastic film according to the second aspect of this invention has been reduced to 1/10–1/100 of that of the plastic film according to the first aspect of this invention. In the second aspect of this invention, the rubbery resin and styrene resin may be similar to those employed in the first aspect of this invention. A transparent printing film having still better properties may also be obtained by forming fine ruggedness on the surface of the film or applying an antistatic treatment as described above with reference to the first aspect of this invention.

According to still another aspect of the invention there is provided a component used as an ink-setting layer deposited or applied to the surface or surfaces of a printing medium, consisting essentially of at least one of a rubbery or rubber-like resin and a styrene resin and a silica sol having an average particle diameter ranging from 3 to 100 mum, in a mixing ratio of 100:15 to 100:150 in weight.

The transparent plastic printing film according to the first aspect of this invention is provided on at least one side thereof an ink-setting layer composed principally of a rubbery resin and/or styrene resin.

The rubbery resin forming the ink-setting layer may be, for example, a styrene-butadiene copolymer, denatured styrene-butadiene copolymer, acrylonitrile-butadiene copolymer, methacrylic ester-butadiene copolymer, acrylonitrile-styrene-butadiene copolymer or methacrylic ester-styrene-butadiene copolymer or a substituted derivative thereof. As illustrative examples of the substituted derivative, may be mentioned carboxylated derivatives or those obtained by rendering these carboxylated derivatives copolymers reactive to alkalis. These polymers may be used either singly or in combination. Among them, carboxylated styrene-butadiene copolymer has been found as a particular preferred one.

As an illustrative example of the styrene resin forming the ink-setting layer, may be mentioned a styrenated alkyd resin, styrene-acrylic ester copolymer or styrene-methacrylic ester copolymer or a substituted derivative thereof. Illustrative examples of the substituted derivative may include carboxylated derivatives or those obtained by rendering these carboxylated derivatives copolymers reactive to alkalis. These polymers may be used either singly or in combination.

The inventors have found that these rubbery (i.e., rubber-like) and styrene resins will have a characteristic of swelling by absorbing a solvent and/or oily component in the oil ink. Especially, these resins will swell to a great extent with a petroleum base solvent having a high boiling point. Accordingly, when the oil ink is printed on the ink-setting layer principally consisting of a rubbery and/or styrene resin, the solvent and/or oily component contained in the oil ink will immediately be absorbed into the ink-setting layer to swell the same. At the same time, the oil ink is thus dehydrated to increase its viscosity and become gelated, providing the ink set condition or apparent dry state. Therefore, even when the printed articles are superposed one over another immediately after printing with the oil ink, there will never arise smearing and bleeding of the oil ink. Further, the oil ink can be well adhered to the said ink-setting layer after oxidative polymerization. Because the ink-setting layer according to this invention is transparent due to its composition and has no micro-void construction as in the conventional one, it is particularly suitable for printing a plastic transparent film.

The thickness of the ink-setting layer should be at least 1 μm with above 3–10μ being preferred The principal component or components of the ink-setting layer are a rubbery resin and/or styrene resin as described above. Depending on required degrees of heat resistance, scratch resistance and the like, one or more other resin components (for example, polyester resins, polyvinyl alcohols, cellulose derivatives) may also be added.

In order to prevent films from being firmly cohered upon their stacking, fine ruggedness may preferably be formed in the films. Such ruggedness may be formed by providing particles on the films. Ruggedness can be provided on one side of a film, said side bearing an ink-setting layer, when particles having a particle size greater than the thickness of the ink-setting layer are mixed in a resin to be employed to form the ink-setting layer. Such particles may also be mixed in a resin composition and then coated on the side opposite to the ink-setting layer so as to form ruggedness on that side. Both sides of a film may also be rendered rugged with particles by applying both methods.

As exemplary particles, may be mentioned silicon dioxide, calcium carbonate, magnesium carbonate, zinc oxide, aluminum hydroxide, titanium oxide, calcium silicate, aluminum silicate, mica, clay, talc, alumina, zinc stearate, calcium stearate, molybdenum disulfide, starch, polyethylene, polypropylene, polystyrene, acrylonitrile, methyl methacrylate, tetrafluoroethylene, ethylene, ethylene-acrylic ester copolymers, and pigments such as Phthalocyanine Blue and red iron oxide. They may be used either singly or in combination.

Leaf-like particles are inconvenient because they are brought into face-to-face contact with adjacent films when the films are stacked. A spherical or like shape is preferred. The average particle size of the particles may preferably be about twice the thickness of the ink-setting layer. Particles of the same shape may be used. Particles of plural different shapes may also be used alternatively.

The amount of particles to be coated varies depending of their material. In the case of silica for example, it is sufficient if silica is applied in an amount of 5 mg/m$^2$ or more. When the total coat weight of particles applied on both sides of a film increases, the resulting film becomes translucent or opaque.

The fine ruggedness may also be formed by processing one or both sides of a film. Ruggedness may be formed, for example, by embossing the film or subjecting one or both sides of the film to sand blasting.

Since a plastic film is electrically an insulator, it is liable to triboelectrification. The lower the surface electric resistance, the less the triboelectrification and the more suitable as a printing film. As a matter of fact, electrical charging occurs little and substantially no tacking takes place provided that the surface electric resistance is below $10^{12}\Omega/\square$ in the surrounding environment (normally, at room temperature of 20° C. and relative humidity of 60%). Actual effects do not change substantially even if the surface electric resistance is lowered further to $10^{8}\Omega/\square$ or lower. The surface electrical resistance is a value measured in accordance with the method prescribed in JIS (Japanese Industrial Standard). Namely, it is a value obtained by firmly applying two electrodes (1 cm long) with an interval of 1 cm in a mutually-opposed relation on a surface to be measured and then measuring the electric resistance between the two electrodes.

In order to reduce the surface electric resistance of the film, a resin with an antistatic agent mixed therein or a conductive paint may be coated by way of example on one side of the film which side is opposite to the ink-fixing layer. A conductive resin, for example, an anionic conductive resin with a metal salt of sulfonic or carboxylic acid incorporated therein, a cationic resin with a quaternary ammonium salt mixed therein or a siloxane-type resin may be coated on a film to provide an electrically conductive layer on the surface of the film. When ruggedness is applied to one side of a film, said one side being opposite to the associated ink-setting layer, by coating a resin composition with particles mixed therein, an antistatic agent or the like may preferably be kneaded in the resin composition. In order to lower the electric resistance of one side of a film which side bears the associated ink-setting layer, an antistatic agent or the like may be kneaded in a resin composition adapted to form the ink-setting layer. Although such an antistatic treatment may be applied to both sides of a film, it may be applied to only side of the film because when films are stacked, one side of each film which side has not been subjected to any antistatic treatment is brought into a contiguous relation with the antistatic side of its adjacent film and electrons charged in the former side are released through the latter side. An antistatic agent or the like may also be kneaded in a film itself in order to lower the surface electric resistance of the film.

The film becomes translucent like frosted glass if its total luminous transmittance and haze are both high. If the total luminous transmittance and haze are both low, the film becomes transparent like smoked glass but is dark as a whole. In order to obtain transparent appearance, it is necessary to control the total luminous transmittance above 80% and the haze below 15%. The control of the total luminous transmittance and haze at such values can be achieved by adjusting the fine ruggedness to be formed in the film.

When forming fine ruggedness with particles applied on a film, the total luminous transmittance and haze vary in accordance with the size, amount, shape and optical properties (i.e., the luminous transmittance of the particles themselves, the relative refractive index to the resin composition in which the particles are mixed) of the particles. The smaller the particle size of the particles, the lower the haze. Ruggedness is however not formed unless the particles protrude from the ink-setting layer (or the resin component of the binder). The particles should therefore have at least such a particle size. As the shape of the particles becomes closer to a sphere, the haze becomes lower. A high total luminous transmission can be imparted if the luminous transmittance of the particles per se is high. However, the haze becomes higher when the relative refractive index is great.

When fine ruggedness is formed by processing one or both sides of a film itself, the total luminous transmittance and haze vary in accordance with the degree, shape and density of the ruggedness. In the case of a film bearing embossed ruggedness for example, the total luminous transmittance decreases as the density of bosses increases. The haze can be maintained small so long as the degree of ruggedness is small and the bosses and lands are semispherical. The total luminous transmittance and haze are determined by the measurement methods prescribed in ASTM D1003-61.

The printing film according to the second aspect of this invention includes on at least one side thereof an ink-setting layer formed by coating said at least one side with a mixture of (i) a solution formed principally of a rubbery resin and/or styrene resin and (ii) a silica sol having a particle size of 3-100 mμm preferably.

In the second aspect of this invention, the plastic film as the base material and the material forming the ink-setting layer may be the same as those employed in the first aspect of this invention. The silica sol has been added in the second aspect of this invention in order to improve the heat blocking resistance, moisture blocking resistance and scratch resistance achieved by the first aspect of this invention.

Silica sol is also called colloidal silica. The particle size of silica ranges 3 to 100 mμm. Silica particles undergo dehydration and condensation to form siloxane bonds, so that while forming a microporous structure, the hardness of the coating film increases to improve the scratch resistance of the surface of the resulting ink-setting layer. The heat blocking resistance and moisture blocking resistance of the surface of the ink-setting layer are both improved by the incorporation of the silica sol. The silica sol also serves to lower the surface electric resistance so that it is also effective for the prevention of triboelectrification. There are two types of silica sols, one being an aqueous silica sol in which silica particles are dispersed in water and are stabilized with cations such as sodium ions and the other organo sol in which the surfaces of silica particles have been rendered hydrophobic and hence soluble in an organic solvent. A suitable silica sol may be selected from these silica sols in accordance with the type of the coating formulation.

The silica sol may be incorporated in the form of a composite material bonded chemically with the rubbery resin and/or styrene resin, which are employed for the formation of the ink-setting layer, by introducing hydroxyl groups into the rubbery resin and/or styrene resin and inducing, for example, dehydration and condensation between the silica sol and the rubbery resin and/or styrene resin to form Si—O—R (R: organic resin).

The weight ratio of the rubbery resin and/or styrene resin to the silica particles in the silica sol may preferably be 100:15-200. If the content of silica particles is 15 parts by weight per 100 parts by weight of the resin component or components, substantially no additional effects can be brought about by the addition of the silica sol. Any contents of silica particles above 200 parts by weight per 100 parts by weight of the resin component or components, the resultant ink-setting layer may be whitened or may develop cracks so that the coating formulation may not be formed successfully into a film and the resultant coating film may hence be weak. In addition, the dampening water compatiblity may be deteriorated and the ink-setting time may be prolonged, thereby impairing the printability.

In the second aspect of this invention, a silica sol is mixed in a coating formulation which is adapted to form an ink-setting layer. When the coating formulation is dried into a coating film, hydroxyl groups of the silica sol undergo mutual dehydration and condensation so that siloxane bonds Si—O—Si are formed to establish a strong three-dimensional network structure. As a consequence, the hardness of the coating film on the surface of the ink-setting layer is increased to improve the scratch resistance. Owing to the inclusion of the silica sol in the ink-setting layer, the resultant printing films do not stick one another and are hence free from blocking problem even when they are left over in a large quantity for a long period of time in an environment of high temperature and humidity. As mentioned above, the heat resistance and moisture resistance have been improved significantly. In addition, the addition of the silica sol has made it possible to reduce the electric resistance of the surface of the ink-setting layer to 1/10-1/100, thereby successfully avoiding possible problems which would otherwise be caused by static electrically to be produced by triboelectrification. The thus-added silica sol is as small as 3-100 mμm in particle size and forms a microporous structure. The particle size of the silica sol is therefore sufficiently small compared with the wavelength of the visible range, i.e., 400-700 mμm, thereby bringing about another advantage that the transparency of the coating film is not lowered by scattered light. The silica sol is excellent particularly when employed in an ink-setting layer of a transparent printing film.

According to a third aspect of the invention there is provided a component used as an ink-setting layer deposited or applied to the surface of surfaces of a printing medium. The composition consists essentially of a rubbery or rubber-like resin and/or styrene resin and a silica sol having an average particle diameter of 3 to 100 mμm, in a mixing ratio of 100:15 to 100:150 in weight. The rubbery resin and/or styrene resin may be the same as those employed in the first and second aspects of this invention. The silica sol may be the same as in the second aspect of this invention. This composition can be applied to a surface or surfaces of any desired printing medium including metal, glass, ceramics, as well as a plastic film, thereby forming an ink-setting layer for well setting the oil ink especially of an oxidative polymerization type.

The present invention will hereinafter be described by the following Examples.

EXAMPLE 1

A bonding-facilitated transparent polyester film of 100 μm thick ("Melinex 505", trade name; product of ICI, England) was coated on one side thereof with a latex (solid content: 30 wt.%) of a methyl methacrylate-butadiene copolymer by a reverse roll coater, followed by drying for 1 minute in a drying oven of 120° C. The resultant film was provided with a 7 μm thick ink-setting layer of the methyl methacrylate-butadiene copolymer.

EXAMPLE 2

A transparent triacetate film having a thickness of 125 μm was coated on one side thereof with a coating formulation, which had been obtained by diluting a rubbery resin having a solid content of 20% ("SF-105" trade name; product of DAINIPPON INK & CHEMICALS, INC.) to a solid content of 10% with ethyl acetate, by a bar coater which was wound by a wire having a diameter of 0.5 mm. The thus-coated film was dried by blowing hot air of 110° C. for 1 minute against same. The resultant film was provided with a 4 μm thick ink-setting layer of the rubber resin.

EXAMPLE 3

A cellophane film having a thickness of 70 μm was coated on one side thereof with a latex (solid content: 25%) of a carboxy-modified styrene-butadiene copolymer. The thus-coated film was then dried by blowing air against same. The resultant film was provided with a 10 μm thick ink-setting layer of the carboxy-modified styrene-butadiene copolymer.

EXAMPLE 4

A bonding-facilitated transparent polyester film of 75 μm thick ("Lumilar Q-80", trade name; product of TORAY INDUSTRIES, INC.) was coated on one side thereof with a coating formulation, which had been obtained by diluting a styrene-acrylic ester copolymer ("Movinyl 860", product of Hoechst Gosei K.K.) with water to a solid content of 30%, by a wire bar coater. The thus-coated film was dried by blowing air against same. The resultant film was provided with a 10 μm thick ink-setting layer of the styrene-acrylic ester copolymer. The other side of the film, which was opposite to the side on which the ink-setting layer had been formed, was coated with a coating formulation of the following composition by a reverse roll coater.

| | parts by weight |
|---|---|
| Nitrocellulose resin | 15 |
| Sodium dodecylphosphate | 0.4 |
| Ethyl acetate | 45 |
| Toluene | 45 |

The thus-coated film was dried by blowing air against same, thereby obtaining an antistatic layer of 3 μm thick. The surface electric resistance of the antistatic layer was $7\times10^{10}\Omega/\square$ at 20° C. and 60% RH.

COMPARATIVE EXAMPLE 1

A transparent polyester film having a thickness of 100 μm was coated on one side thereof with a coating formulation, which had been obtained by dissolving a vinyl chloride-vinyl acetate copolymer in a mixed solvent of methyl ethyl ketone and toluene and had a solid content of 15%, by a reverse roll coater. The thus-coated film was then dried by blowing air against same. The resultant film was provided with an 8 μm thick layer of the vinyl chloride-vinyl acetate copolymer.

EXAMPLE 5

A bonding-facilitated transparent polyester film of 100 μm thick ("Melinex 505", trade name; product of ICI, England) was coated on one side thereof with a mixture of a latex (solid content: 30 wt.%) of a methyl methacrylate-butadiene copolymer and 0.1 wt.% of silica powder (average particle size 10 μm) by a reverse roll coater, followed by drying for 1 minute in a drying oven of 120° C. The resultant film was provided with a 7 μm thick ink-setting layer of the methyl methacrylate-butadiene copolymer. Silica particles protruded from the ink-setting layer so that ruggedness was presented over the entire surface. The other side opposite to the side on which the ink setting layer had been formed, was coated with a solution having the following composition by a wire bar coater.

| | parts by weight |
|---|---|
| Cellulose acetate proprionate | 10 |
| "Syloyd 244" (trade name; synthetic silica produced by Fuji-Davison Chemical, Ltd.; particle size: 3.5 μm) | 0.04 |
| Methyl cellosolve | 40 |
| Toluene | 40 |

Air of 120° C. was blown for 1 minute against the coated surface to fix the ruggedness of the synthetic silica particles.

EXAMPLE 6

One side of a transparent polyester film having a thickness of 100 μm ("Lumilar Q-80", trade name; product of TORAY INDUSTRIES, INC.) was embossed by a finely-textured roll. The opposite side of the film was then coated with a latex (solid content: 30 wt.%) of a methyl methacrylate-butadiene copolymer by a reverse roll coater, followed by drying for 1 minute in a drying oven of 120° C. to form an ink-setting layer. Ruggedness had been formed on the opposite side by the embossing processing.

EXAMPLE 7

A bonding-facilitated transparent polyester film of 75 μm thick ("Lumilar Q-80", trade name; product of TORAY INDUSTRIES, INC.) was coated on one side thereof with a coating formulation, which had been obtained by diluting a styrene-acrylic ester copolymer ("Movinyl 860", product of Hoechst Gosei K.K.) with water to a solid content of 30%, by a wire bar coater. The thus-coated film was dried by blowing air against same. The resultant film was provided with a 10 μm thick ink-setting layer of the styrene-acrylic ester copolymer. The other side of the film, which was opposite to the side on which the ink-setting layer had been formed, was coated with a coating formulation of the following composition by a reverse roll coater.

| | parts by weight |
|---|---|
| Nitrocellulose resin | 15 |
| Sodium dodecylphosphate | 0.4 |
| crosslinked spherical polystyrene particles (average particle size: 6 μm; "Fine Pearl 3000sp", trade name; product of SUMITOMO CHEMICAL INDUSTRIES, LTD.) | 1 |
| Ethyl acetate | 45 |
| Toluene | 45 |

The thus-coated film was dried by blowing air against same, thereby obtaining an antistatic layer of 3 μm thick. The surface electric resistance of the antistatic layer was $7\times10^{10}\Omega/\square$ at 20° C. and 60% RH. The crosslinked spherical polystyrene particles protruded from the antistatic layer, thereby presenting ruggedness.

EXAMPLE 8

A cellophane film having a thickness of 70 μm was coated on one side thereof with a mixture of a latex (solid content: 25%) of a carboxy-modified styrene-butadiene copolymer and 2 wt.% of silica powder (average particle size: 10 μm). The thus-coated film was then dried by blowing air against same. The resultant film was provided with a 6 μm thick ink-setting layer of the carboxy-modified styrene-butadiene copolymer from which silica particles protruded.

The opposite side of the film was then coated by a reverse roll coater with a coating formulation of the following composition:

| | parts by weight |
|---|---|
| Quaternary ammonium salt of cationic acrylic resin ("Cebien A830", trade name; solid content: 30 wt. %; product of DAICEL CHEMICAL CO., LTD.) | 30 |
| Fine spherical particles of polymethyl methacrylate (average particle size: 6 μm) | 0.2 |
| Methanol | 70 |

Air of 120° C. was blown for 1 minute against the coated side to obtain an antistatic layer presenting ruggedness of the particles of the polymethyl methacrylate. The surface electric resistance of the antistatic layer was $5\times10^8\Omega/$ at 20° C. and 60% RH.

COMPARATIVE EXAMPLE 3

A transparent polyester film having a thickness of 100 μm was coated on one side thereof with a coating formulation, which had been obtained by dissolving a vinyl chloride-vinyl acetate copolymer in a mixed solvent of methyl ethyl ketone and toluene and adding 0.2 parts by weight of silica powder (average particle size: 10 μm) had a solid content of 15%, by a reverse roll coater. The thus-coated film was then dried by blowing air against same. The resultant film was provided with an 8 μm thick layer of the vinyl chloride-vinyl acetate copolymer.

EXAMPLE 9

A bonding-facilitated transparent polyester film of 100 μm thick ("Melinex 505", trade name; product of ICI, England) was coated on one side thereof with a mixture of a latex (solid content 30 wt %) of a methyl methacrylate-butadiene copolymer and 8 wt.% of crosslinked polystyrene beads (average particle size: 15 μm; "Fine Pearl PB 300", trade name; product of SUMITOMO CHEMICAL CO., LTD.) by a reverse roll coater, followed by drying for 1 minute in a drying oven of 120° C. The resultant film was provided with an ink-setting layer of the methyl methacrylate-butadiene copolymer. The crosslinked polystyrene beads were dispersed at a rate of 0.7 g/m$^2$ in the ink-setting layer and protruded from the ink-setting layer, thereby presenting ruggedness. The total luminous transmittance and haze of the film were 90.3% and 12.0% respectively.

EXAMPLE 10

A transparent triacetate film having a thickness of 125 μm was coated on one side thereof with a coating formulation, which had been obtained by diluting a rubbery resin having a solid content of 20 wt.% ("SF-105" trade name; product of DAINIPPON INK & CHEMICALS, INC.) to a solid content of 10% with ethyl acetate, by a bar coater which was wound by a wire having a diameter of 0.5 mm. The thus-coated film was dried by blowing hot air of 110° C. for 1 minute against same. The resultant film was provided with an ink-setting layer of the rubbery resin.

In order to apply ruggedness to the other side opposite to the side on which the ink-setting layer had been formed, the other side was coated with a coating formulation of the following composition by a wire bar coater.

| | parts by weight |
|---|---|
| Cellulose acetate proprionate | 10 |
| "Syloyd 244" (trade name; synthetic silica produced by Fuji-Davison Chemical, Ltd.; particle size: 3.5 μm) | 0.5 |
| Methyl cellosolve | 45 |
| Toluene | 45 |

Air of 120° C. was blown for 1 minute against the coated surface to fix the ruggedness of the synthetic silica particles.

The resultant film had the ink-setting layer on one side thereof and presented on the opposite side ruggedness of the silica particles dispersed at a rate of 0.01 g/m$^2$. The total luminous transmittance and haze of the film were 90.6% and 4.1% respectively.

EXAMPLE 11

A bonding-facilitated transparent polyester film of 75 μm thick ("Lumilar Q-80", trade name; product of TORAY INDUSTRIES, INC.) was coated on one side thereof with a coating formulation, which had been obtained by diluting a styrene-acrylic ester copolymer ("Movinyl 860", product of Hoechst Gosei K.K.) with water to a solid content of 30%, by a wire bar coater. The thus-coated film was dried by blowing air against same. The resultant film was provided with an ink-setting layer of the styrene-acrylic ester copolymer. The other side of the film, which was opposite to the side on which the ink-setting layer had been formed, was coated with a coating formulation of the following composition by a reverse roll coater.

| | parts by weight |
|---|---|
| Nitrocellulose resin | 10 |
| Sodium dodecylphosphate | 0.4 |
| Polyethylene beads (average particle size: 5 μm) | 1 |
| Ethyl acetate | 45 |
| Toluene | 45 |

The resultant film had the ink-setting layer on one side thereof and an antistatic layer on the opposite side. In the antistatic layer, the polyethylene beads were dispersed at a rate of 0.1 g/m$^2$, thereby presenting ruggedness. The total luminous transmittance and haze of the film were 89.3% and 6.3% respectively. The surface electric resistance of the antistatic layer was $7\times10^{10}\Omega/\square$ at 20° C. and 60% RH.

EXAMPLE 12

A cellophane film having a thickness of 70 μm was coated on one side thereof with a mixture of a latex (solid content: 25%) of a carboxy-modified styrene-butadiene copolymer and 0.5 wt.% of talc powder (average particle size: 10 μm). The thus-coated film was then dried by blowing air against same. The resultant film was provided with an ink-setting layer of the carboxy-modified styrene-butadiene copolymer from which talc particles protruded to present ruggedness.

The opposite side of the film was then coated by a reverse roll coater with a coating formulation of the following composition:

| | parts by weight |
|---|---|
| Quaternary ammonium salt of cationic acrylic resin ("Cebien A830", trade name; solid content: 30 wt. %; product of DAICEL CHEMICAL CO., LTD.) | 30 |
| "Syloyd 244" | 0.5 |
| Methanol | 70 |

Air of 120° C. was blown for 1 minute against the coated side to obtain an antistatic layer presenting ruggedness of the particles of the polymethyl methacrylate. The surface electric resistance of the antistatic layer was $5\times10^{8}\Omega/\square$ at 20° C. and 60% RH. The total luminous transmittance and haze of the film were 83.2% and 10.3% respectively.

COMPARATIVE EXAMPLE 4

The ink-setting layer containing a vinyl chloride-vinyl acetate copolymer was prepared in the same manner as in Comparative Example 3 but formed on a cellophane film having the total luminous transmittance of 86.1% and haze of 6.3.

COMPARATIVE EXAMPLE 5

A bonding-facilitated transparent polyester film of 75 μm thick ("Lumilar Q-80", trade name; product of TORAY INDUSTRIES, INC.) was coated on one side thereof with a coating formulation having the following composition by a reverse roll coater, while being dispersed with a sand mill. The thus-coated film was dried by blowing air against same.

| | parts by weight |
|---|---|
| Vinyl chloride vinyl acetate copolymer | 10 |
| Precipitated calcium carbonate (average particle size of 3 mμm) | 20 |
| "Syloyd 244" | 3 |
| Methyl ethyl ketone | 15 |
| Toluene | 52 |

The film was ten coated with an ink-setting layer of 10 μm thickness thereon, which was prepared from vinyl chloride and vinyl acetate copolymer and an inorganic filler in a mixing ratio of 1:2:3 in weight. This film had the total luminous transmittance of 42.0 and haze of 88.7% and was white-colored, i.e. opaque.

The printing films obtained in the above Examples were cut into a prescribed size, thereby providing sheet-like films. The sheet-like films were separately loaded on a lithographic offset press and actually subjected to multicolor printing with inks, "TOYO KING MARK V" (trade name; product of TOYO INK MFG. CO., LTD.). Results are summarized in Table I. In the same table, the printing films of Comparative Example 2 was a cellophane film having no ink-setting layer. In the table, the "print strength" was evaluated by applying an adhesive tape on the printed surface of each sheet, quickly peeling off the adhesive tape and observing the degree of separation of the print.

TABLE I

| | Ink setting | Film running | Heat resistance | Moisture resistance | Scratch resistance | Print strength |
|---|---|---|---|---|---|---|
| Example 1 | ○ | Δ | ○ | ○ | ○ | ○ |
| Example 2 | ○ | Δ | Δ | ○ | ○ | ○ |
| Example 3 | ○ | Δ | Δ | ○ | ○ | ○ |
| Example 4 | ○ | ○ | Δ | ○ | Δ | ○ |
| Comp. Ex. 1 | X | X | ○ | ○ | ○ | X |
| Comp. Ex. 2 | X | Δ | ○ | ○ | ○ | X |
| Example 5 | ○ | Δ | ○ | ○ | ○ | ○ |
| Example 6 | ○ | Δ | ○ | ○ | ○ | ○ |
| Example 7 | ○ | ○ | Δ | ○ | ○ | ○ |
| Example 8 | ○ | ○ | Δ | ○ | ○ | ○ |
| Comp. Ex. 3 | X | ○ | ○ | ○ | ○ | X |
| Comp. Ex. 4 | X | Δ | ○ | ○ | ○ | X |
| Example 9 | ○ | Δ | ○ | ○ | ○ | ○ |
| Example 10 | ○ | Δ | ○ | ○ | ○ | ○ |
| Example 11 | ○ | ○ | Δ | ○ | ○ | ○ |
| Example 12 | ○ | ○ | Δ | ○ | ○ | ○ |
| Comp. Ex. 5 | X | Δ | ○ | ○ | ○ | X |

○ : superior Δ: not poor X: poor

It has been appreciated from the results shown in Table I that the oil ink can be well adhered and deposited onto the ink-setting layer prepared according to the invention, and the films thus printed can provide improved print strength. Other properties such as film running, heat resistance, moisture resistance and scratch resistance can also be kept at a practically satisfactory level. On the contrary, data of Comparative Examples 1 and 3 revealed the fact that the ink setting layer consisting essentially of vinyl chloride-vinyl acetate copolymer, which has typically been employed as a resin component of the conventional ink-setting layer, was not satisfactory especially in the ink-setting property and the print strength. The results of Comparative Example 4 shows that the ink-setting layer of vinyl chloride-vinyl acetate copolymer can maintain its transparency but provide degraded ink setting property and print strength. When the filler was incorporated into the ink-setting layer of Comparative Example 4 as in Comparative Example 5, the ink-setting property and the print strength can be improved but the film will become opaque.

EXAMPLE 13

A bonding-facilitated transparent polyester film of 100 μm thick ("Melinex 505", trade name; product of ICI, England) was coated on one side thereof with an aqueous coating formulation (solid content: 30 wt.%), which was a 1:1 (by solid weight ratio) mixture of a latex of a methyl methacrylate-butadiene copolymer and aqueous silica sol (average particle size: 12 mμm), by a reverse roll coater, followed by drying for 1 minute in a drying oven of 120° C. The resultant film was provided with a 7 μm thick ink-setting layer of the methyl methacrylate-butadiene copolymer.

EXAMPLE 14

A polycarbonate film having a thickness of 100 μm was coated on one side thereof with a coating formulation of the following composition by a reverse roll coater.

| | parts by weight |
|---|---|
| Quaternary ammonium salt of cationic acrylic resin ("Cebien A830", trade name; solid content: 30 wt. %; product of DAICEL CHEMICAL CO., LTD.) | 30 |
| Synthetic silica ("Syloyd 244", trade name; average particle size: 3.5 μm; product of Fuji-Davison Chemical, Ltd.) | 0.5 |
| Methanol | 40 |
| Toluene | 30 |

Air of 120° C. was blown for 1 minute against the coated side to obtain an antistatic layer. The opposite side was coated by a wire bar coater with an emulsion coating formulation (solid content: 25%) of a styrene-acrylic ester-silica sol composite material (silica sol content: 50 wt%). Air of 110° C. was blown for 1 minute against the coated side to form an ink-setting layer of 10 μm thick.

EXAMPLE 15

A polycarbonate film having an antistatic layer on the back side thereof and an ink-setting layer of 10 μm thick on the front side thereof was obtained in the same manner as in Example 14 except that the coating formulation for the formation of the ink-setting layer was changed to the following composition.

| | parts by weight |
|---|---|
| Emulsion of styrene-acrylic ester-silica sol composite material (solid content: 45%; silica sol content: 50 wt. % of the whole solids) | 50 |
| Aqueous silica sol solution (solid content: 40%; average particle size: 10 mμm) | 20 |
| Water | 30 |

In the ink-setting layer o this Example, 170 parts by weight of silica sol were contained per 100 parts by weight of the styrene-acrylic ester copolymer.

COMPARATIVE EXAMPLE 6

The procedure of Example 1 was repeated except that the mixing ratio of the latex of the methyl methacrylate-butadiene copolymer to the aqueous silica sol in Example 13 was changed to 9:1, thereby forming a 7 μm thick ink-setting layer composed of the methyl methacrylate-butadiene copolymer and the aqueous silica sol at a weight ratio of 9:1.

COMPARATIVE EXAMPLE 7

The procedure of Example 1 was repeated except that the mixing ratio of the latex of the methyl methacrylate-butadiene copolymer to the aqueous silica sol in Example 13 was changed to 2:8. The coating film formed on the film was weak and developed cracks readily. It was not suitable for use.

COMPARATIVE EXAMPLE 8

The procedure of Example 2 were repeated except that an emulsion (solid content: 30%) of a styrene-acrylic ester copolymer was used as the coating formulation employed in Example 14 for the formation of the ink-setting layer, thereby obtaining a polycarbonate film having on the back side an antistatic layer and on the front side an ink-setting layer of 10 μm thick made of the styrene-acrylic ester copolymer.

The printing films obtained above in Examples 13–15 and Comparative Examples 6–8 were cut into a prescribed size, thereby providing sheet-like films. The sheet-like films were separately loaded on a lithographic offset press and actually subjected to multicolor printing with inks, "TOYO KING MARK V" (trade name; product of TOYO INK MFG. CO., LTD.). Results are summarized in Table II.

The term "coating film" as will be used in the table means an ink-setting layer. In the table, the "print strength" was evaluated by applying an adhesive tape on the printed surface of each sheet, quickly peeling off the adhesive tape and observing the degree of separation of the print. The "pencil hardness" and "total luminous transmission and haze" of each coating film were determined respectively by the measuring methods prescribed in JIS K5400 and JIS K7105 (which corresponds to ASTM D1003-61). The "surface electric resistance" of each coating film was measured as a 1-minute value under a voltage of 100 V after allowing each sample to stand for 24 hours at 20° C. and 65% RH. The "heat resistance" and "moisture resistance" of each coating film were evaluated by bringing the front side of a sheet of the film into contiguous relation with the back side of another sheet of the same film, allowing the sheets to stand at 60° C. and 90% RH for 72 hours under a load of 1 kg/cm$^2$ and then peeling off the sheets from each other.

TABLE II

| | Example 13 | Example 14 | Example 15 | Comp. Ex. 6 | Comp. Ex. 7 | Comp. Ex. 8 |
|---|---|---|---|---|---|---|
| Offset ink | ○ | ○ | ○ | ○ | Coating | ○ |

TABLE II-continued

| | Example 13 | Example 14 | Example 15 | Comp. Ex. 6 | Comp. Ex. 7 | Comp. Ex. 8 |
|---|---|---|---|---|---|---|
| settability | | | | | film | |
| Film running property | Δ | ○ | ○ | Δ | not formed | ○ |
| Print strength | ○ | ○ | ○ | ○ | | ○ |
| Heat resistance of coating film | ○ | ○ | ○ | ○ | | Δ |
| Moisture resistance of coating film | ○ | ○ | ○ | Δ | | Δ |
| Pencil hardness of coating film | F | HB | 2H | 3B | | 5B |
| Surface resistance of coating film (Ω/□) | $6 \times 10^{12}$ | $5 \times 10^{12}$ | $3 \times 10^{11}$ | $4 \times 10^{14}$ | | $2 \times 10^{13}$ |
| Total luminous transmittance (%) | 89.2 | 89.5 | 89.6 | 89.6 | | 89.3 |
| Haze (%) | 1.2 | 4.0 | 4.5 | 1.3 | | 4.2 |

○ : superior Δ: not poor

As has been described above, the transparent plastic printing film of this invention is provided with an ink-setting layer on at least one side thereof. The adhesion of a printing ink to the coated side (namely, the wettability of the coated side with the printing ink), the absorption of the printing ink in the coated side and the drying and hardening properties of the printing ink on the coated side are all excellent. In the case of a lithographic offset printing ink by way of example, the drying oil is believed to undergo oxidative polymerization while the solvent component of its vehicle is absorbed and/or caused to evaporate. Air is hence required to bring the oxidative polymerization to completion and to dry and harden the ink. This process is certainly time-consuming. Transparent plastic films of this invention are however not smeared even when they stacked before the complete drying and hardening of the ink is achieved by oxidative polymerization of the drying oil, since the ink is firmly held on the ink-setting layer on the surface of each film, the solvent component has been absorbed in the ink-setting layer and the viscosity of the ink has increased to a sufficient extent.

In the preferred embodiment, fine ruggedness is formed on each film. Air is hence held in spacing in the rugged surface. Therefore, the printing ink is exposed to the air and undergoes an oxidative polymerization reaction to accelerate the drying and hardening of the ink. When such films are stacked together, they do not cohere so that they remain slidable against each other. Owing to this feature, they can be fed with good accuracy of register into a printing machine and after printing, they can be piled up in complete registration. Namely, they have good running property. The surface electric resistance is preferably controlled below $10^{12}\Omega/\square$. In this case, the electrification of printing films is little and the running trouble due to tacking can be avoided.

EXAMPLE 16

An aluminum foil paper consisting of a lining paper of 40 g/m$^2$ and an aluminum foil of 7 μm in thick superposed on each other was prepared. To the aluminum foil surface was applied a polyester type primer, which was then dried to form an anchor coating layer of 2 μm in thick on the aluminum foil surface. The anchor coating layer was then coated with a coating formulation having the following composition by a reverse roll coater, followed by drying in a drying oven of 130° C. for 2 minutes, to form an ink setting layer of 7 μm in thick.

| | parts by weight |
|---|---|
| Latex of methyl methacrylate-butadiene copolymer solid content: 40% in weight) | 35 |
| Aqueous silica sol solution (solid content: 40% in weight; average particle size: 15 μm | 35 |
| Water | 30 |

As apparent from the above, the ink-setting layer contained methyl methacrylate-butadiene copolymer and silica sol in a mixing ratio of 1:1.

The aluminum foil paper thus prepared was subjected to multicolor printing utilizing offset printing process inks of oxidative polymerization type colored in four different colors, with an offset printing machine. The color printing was performed for continuous 1,000 sheets of the paper. The inks were completely set in a short period of time, namely within 2 hours. No smearing of the inks was found while storing the aluminum foil paper in a superposed fashion. After oxidatively polymerized, the ink showed good adherence to the ink setting layer and no peeling off of the ink was found in the peeling-off test utilizing an adhesive tape, so that a clear printed image was obtained and maintained. The pencil hardness of the ink-setting layer thus prepared was determined as "F" in the JIS K5400 method. Further, the ink-setting layer was well transparent and provided luster inherent to the aluminum foil material.

As a comparison, an unprocessed aluminum foil paper was subjected to the offset printing in the same conditions to find that the inks were still not set in 10 hours after printing. The inks were often smeared to another, superposed paper.

EXAMPLE 17

A coating formulation prepared by the following composition was applied to a transparent glass sheet of 3 mm in thickness with a wire bar coater, followed by drying in an oven of 140° C. for 2 minutes, to form an ink-setting layer of 9 μm in thick on a surface of the glass sheet.

| | parts by weight |
|---|---|
| Emulsion of styrene-acrylic ester- | 50 |

-continued

| | parts by weight |
|---|---|
| silica sol composite material (solid content: 45 wt. % silica sol content: 50 wt. % of the whole solids | |
| Aqueous silica sol solution (solid content: 40 wt. %; average particle size: 12 mμm | 20 |
| Water | 30 |

In the ink setting layer thus prepared, 126 parts by weight of silica sol were mixed with 100 parts by weight of styrene-acryl copolymer resin.

The ink-setting layer did not change the transparency of the base bacterial, that is the glass sheet. The pencil hardness was determined as "3H" and the scratch resistance property was satisfactory.

The glass sheet thus prepared was subjected to lithographic offset with an ink of oxidative polymerization type. The ink setting was completed in 3 hours and a clear image was printed with an improved adhesiveness.

As has been described above, the transparent plastic printing films of this invention are suitable for lithographic offset and letterpress printing where inks of the oxidative polymerization type are used. By such printing processes, the transparency of the printing films is not lost. The present invention can therefore be advantageously employed in the printing field of transparent plastic films such as various cards, forms, films for overhead projectors and bags for foods.

The embodiments of this invention in which an exclusive property or previledge is claimed are defined as follows:

1. A composite transparent plastic printing film suitable for printing with an oil ink of the oxidative polymerization type containing fluidable ingredients including a drying oil and a petroleum solvent having a high boiling point, said printing film, comprising:

a transparent plastic film; and an ink-setting layer provided on at least one side of said transparent plastic film, said ink-setting layer consisting essentially of one or more resin materials which swell by absorbing the fluidable ingredients contained in the oil ink and a silica sol having a particle size of 3–100 mμm for improving blocking resistance and scratch resistance, and for preventing triboelectrification.

2. A composite transparent plastic printing film as claimed in claim 1, wherein said resin material is a least one butadiene copolymer selected from the group consisting of styrene-butadiene copolymers, acrylonitrile-butadiene copolymers, methacrylic ester-butadiene copolymers, acrylonitrile-styrene-butadiene copolymers, methacrylic ester-styrene-butadiene copolymers and carboxylated derivatives thereof.

3. A composite transparent plastic printing film as claimed in claim 1, wherein the weight ratio of (i) said one resin and (ii) the silica component in said silica sol is in a range of from 100:15 to 100:200.

4. A composite transparent plastic printing film as claimed in claim 1, wherein said composite transparent printing film presents a total luminous transmittance of above 80% and a haze of below 15%.

5. In a method of printing with an oil ink containing fluid ingredients and being of the oxidative polymerization type, onto a non-absorbent substrate, the improvement comprising applying the ink to the ink setting layer provided on the composite transparent plastic printing film as claimed in claim 1.

6. The method as claimed in claim 5, wherein said composite transparent printing film presents a total luminous transmittance of above 80% and a haze of below 15%.

7. The method of claim 5 wherein the silica sol is present in a ratio of (i) said resin to (ii) the silica component in said silica sol in the range of from 100:15 to 100:200.

8. The method as claimed in claim 5, wherein said resin material is a least one butadiene copolymer selected from the group consisting of styrene-butadiene copolymers, acrylonitrile-butadiene copolymers, methacrylic ester-butadiene copolymers, acrylonitrile-styrene-butadiene copolymers, methacrylic ester-styrene-butadiene copolymers and carboxylated derivatives thereof.

9. A composite transparent plastic printing film suitable for printing with an oil ink of the oxidative polymerization type containing fluidable ingredients including a drying oil and the petroleum solvent having a high boiling point, said printing film, comprising:

a transparent plastic film; and an ink-setting layer provided on a least one side of said transparent plastic film, said ink-setting layer consisting essentially of one or more resin materials which swell by absorbing the fluidable ingredients contained in the oil ink and a silica sol having a particle size of 3–100 mμm for improving blocking resistance and scratch resistance, and for preventing triboelectrification;

said composite transparent plastic film presenting a fine rugged surface on at least one side thereof for entry of air between two adjacent films when superposed on one another.

10. A composite transparent plastic printing film as claimed in claim 9, wherein said resin material is a least one butadiene copolymer selected from the group consisting of styrene-butadiene copolymers, acrylonitrile-butadiene copolymers, methacrylic ester-butadiene copolymers, acrylonitrile-styrene-butadiene copolymers, methacrylic ester-styrene-butadiene copolymers and carboxylated derivatives thereof.

11. A composite transparent plastic printing film as claimed in claim 9, wherein the weight ratio of (i) said one resin and (ii) a silica component in said silica sol is in a range of from 100:15 to 100:200.

12. A composite transparent plastic printing film as claimed in claim 9, wherein said composite transparent printing film presents a total luminous transmittance of above 80% and a haze of below 15%.

13. In a method of printing with an oil ink containing fluid ingredients and being of the oxidative polymerization type, onto a non-absorbent substrate, the improvement comprising applying the ink to the ink setting layer provided on the composite transparent printing film as claimed in claim 9.

14. The method of claim 13 wherein the silica sol is present in a ratio of (i) said resin to (ii) the silica component in said silica sol in the range of from 100:15 to 100:200.

* * * * *